US006819767B1

(12) United States Patent
Funahashi et al.

(10) Patent No.: US 6,819,767 B1
(45) Date of Patent: Nov. 16, 2004

(54) SPEAKER UNIT AND SOUND REPRODUCTION APPARATUS USING THE SAME

(75) Inventors: Osamu Funahashi, Osaka (JP); Hiroyuki Morimoto, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 729 days.

(21) Appl. No.: 09/661,788

(22) Filed: Sep. 14, 2000

(51) Int. Cl.[7] ..... H04R 5/00

(52) U.S. Cl. ..... 381/27; 381/400; 381/335; 381/182

(58) Field of Search ..... 381/27, 401, 335, 381/111, 182, 402, 300, 61

(56) References Cited

U.S. PATENT DOCUMENTS

| | | | | |
|---|---|---|---|---|
| 4,164,988 A | | 8/1979 | Virva | |
| 5,708,719 A | | 1/1998 | Greenberger et al. | |
| 5,854,847 A | * | 12/1998 | Yoshida et al. | 381/302 |

FOREIGN PATENT DOCUMENTS

| | | | | |
|---|---|---|---|---|
| DE | 195 23 682 A1 | | 1/1997 | |
| JP | 355046646 A | * | 4/1980 | H04R/5/04 |
| JP | 355073197 A | * | 6/1980 | H04R/9/06 |
| JP | 401272296 A | * | 10/1989 | H04R/1/02 |
| JP | 404340517 A | * | 11/1992 | G02B/26/00 |
| WO | WO 009831187 A1 | * | 7/1998 | H04R/1/28 |

* cited by examiner

*Primary Examiner*—Melur Ramakrishnaiah
(74) *Attorney, Agent, or Firm*—Wenderoth, Lind & Ponack, L.L.P.

(57) ABSTRACT

A sound reproduction apparatus includes a left channel speaker apparatus for receiving a left-channel sound output signal of a sound source, a right channel speaker apparatus for receiving a right-channel sound output signal and a center speaker apparatus disposed at the center, or in the central front space between the speaker apparatuses for the left and the right channels. A speaker unit of the center speaker apparatus is provided with a left-channel voice coil for receiving the left-channel sound output signal and a right-channel voice coil for receiving the right-channel sound output signal; and these two voice coils are disposed co-axially. The center speaker apparatus is formed only of the above-described speaker unit, a front baffle and a cabinet. The amplifying unit that was indispensable in the conventional configuration has been totally eliminated.

6 Claims, 19 Drawing Sheets

SPEAKER UNIT AND SOUND REPRODUCTION APPARATUS USING THE SAME

BACKGROUND OF THE INVENTION

The present invention relates to a sound reproduction apparatus; and more specifically, to a sound reproduction apparatus having a superior capability of positioning the acoustical image in a certain specific place. The capability provides a significant advantage when it is installed in the room of an automobile body. The invention also relates to a speaker unit used in the sound reproduction apparatus.

DESCRIPTION OF THE PRIOR ART

Car-borne loud speakers are mounted, in most cases, in front doors, or the like places in the room of an automobile body. Under such a speaker layout, it is not easy to place the acoustical image at a location in the central front area. In order to have the acoustical image placed at the central front area, it has been a normal practice to install a center speaker apparatus dedicated to reproduction of middle-range frequency sound at the center of a dashboard, or other place in the central front space in the room of an automobile body, the place being located in the middle between a left channel speaker apparatus and a right channel speaker apparatus.

A conventional center speaker apparatus is described in the following. FIG. 17 is an exploded perspective view of a conventional center speaker apparatus. Referring to FIG. 17, a front baffle 1702 is for holding a speaker unit 1701 thereon. A cabinet 1703 and the front baffle 1702 enclose the rear sound output of the speaker unit 1701. A voltage amplifier 1704 mixes the left channel sound input signals and the right channel sound input signals together, and delivers only the middle range frequency sound signals of the mixed signals through a band pass filter. A power amplifier 1705 amplifies the sound signals from voltage amplifier 1704, and delivers them to the speaker unit 1701. A power supply 1706 supplies power to the voltage amplifier 1704 and the power amplifier 1705. A radiator 1707 dissipates heat generated at the power amplifier 1705.

FIG. 18 is a block diagram, which describes a setup with the conventional center speaker apparatus used in a car-borne application. In FIG. 18, a left channel speaker apparatus 1801 is mounted in a front door at a passenger seat, while a right channel speaker apparatus 1802 is mounted in a front door at a driver seat. A center speaker apparatus 1803 is provided at the center, or in the central front space of an automobile body, and reproduces only the middle range frequency sounds. A sound source 1804 comprises a program source, such as a CD player, an FM/AM tuner, and a power amplifier which drives the left and the right speaker apparatuses 1801, 1802.

FIG. 19 illustrates a layout of speakers in an automobile room, using the conventional center speaker apparatus.

Now in the following, operation of the above-described conventional center speaker apparatus is described.

Referring to FIG. 18, sounds are reproduced by the left channel speaker apparatus 1801 and the right channel speaker apparatus 1802, both connected to the sound source 1804. Sound output signals from the program source of the sound source 1804 are also sent to the conventional center speaker apparatus 1803. The sound signals sent from the program source of the sound source 1804 are led to the voltage amplifier 1704, shown in FIG. 17; where, the left channel sound signal and the right channel sound signal are mixed and converted into monaural signals. The mixed sound signals are sent through a band pass filter, so that only the middle range frequency sound signal components responsible to the vocal region are supplied. The sound signals sent from the voltage amplifier 1704 are amplified at the power amplifier 1705 and drive the speaker unit 1701. Then, a sound is reproduced from the speaker unit 1701.

FIG. 19 shows a location of the conventional center speaker apparatus 1803 installed in the room of an automobile body. The speaker apparatus 1803 is placed in the central part of the dashboard, and the speaker apparatus 1803 generates the middle range sound centered in vocal region. By so doing, the acoustical image can be positioned naturally in the central front area without ill-affecting the stereophonic sound feeling.

In this way; namely, by providing a middle-range-dedicated center speaker apparatus at the center, or in the central front area between the left channel speaker apparatus and the right channel speaker apparatus; the natural sound environments having the acoustical image positioned at the central front space may be implemented without sacrificing the stereophonic sound feeling, even in such car-borne cases where the locations for installing speakers are limited, for example, to front doors, hence, positioning the acoustical image in the central front space is difficult.

Thus, the conventional center speaker apparatus can provide natural sound environments with the acoustical image positioned at the central front space. However, the conventional center speaker apparatus requires extra items such as a voltage amplifier 1704, a power amplifier 1705, a power supply 1706, a radiator 1707 or the like, in addition to the basic constituent members, such as the speaker unit, the front baffle and the cabinet. These extra items have been a blocking factor against the efforts to reduce the size and weight of such a speaker apparatus.

The present invention addresses the above problems and aims to offer a compact, light-weight, simple-structured center speaker apparatus, where the voltage amplifier, the power amplifier, the power supply and the heat radiator are eliminated.

SUMMARY OF THE INVENTION

A sound reproduction apparatus of the present invention comprises:

- a left channel speaker apparatus for receiving a sound output signal delivered from the left channel of a sound source,
- a right channel speaker apparatus for receiving a sound output signal delivered from the right channel of the sound source, and
- a center speaker apparatus disposed at the center, or in the central front space between the speaker apparatuses for the left and the right channels.

A speaker unit of the center speaker apparatus is provided with a left-channel voice coil for receiving the left channel sound output signal and a right-channel voice coil for receiving the right channel sound output signal. These voice coils are disposed in a co-axial arrangement.

The speaker unit of the present invention comprises, like conventional speaker units, a diaphragm coupled with a voice coil bobbin, a suspending means to mechanically suspend the diaphragm and the voice coil bobbin, and a magnetic circuit for providing magnetic flux for the two voice coils. A frame for mounting the suspending means and the magnetic circuit thereon is of course included. The center speaker apparatus of the present invention is formed only of the above-described speaker unit, a front baffle and a cabinet; amplifying items indispensable to the conventional center speaker apparatus have been eliminated.

The center speaker apparatus of the present invention eliminates the voltage amplifier, the power amplifier, the power supply and the heat radiator, and has a simplified structure. Thus, the center speaker apparatus can be made compact and light in weight.

DETAILED DESCRIPTION OF THE INVENTION

Exemplary embodiments of the present invention are described below, referring to FIG. 1 through FIG. 16.

Figure 1:
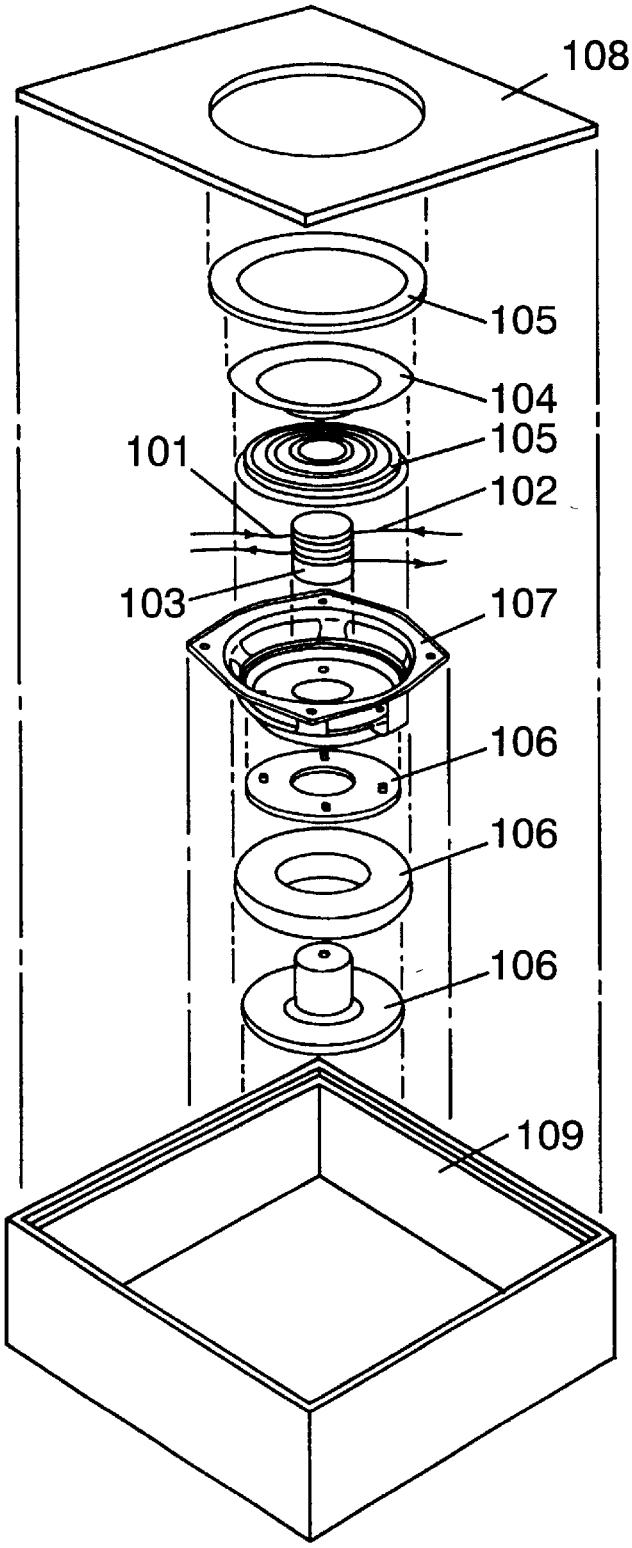
FIG. 1 is an exploded perspective view of a center speaker apparatus of a first sound reproduction apparatus in an exemplary embodiment of the present invention.

FIG. 1 shows an exploded perspective view of a center speaker apparatus in a first sound reproduction apparatus. In FIG. 1, a left-channel voice coil 101 and a right-channel voice coil 102 are provided co-axially on a voice coil bobbin 103. A diaphragm 104 is connected with the voice coil bobbin 103, whose driving force drives the diaphragm to reproduce the sound. The diaphragm 104 and the voice coil bobbin 103 are mechanically supported by a suspension 105. A magnetic circuit 106 provides magnetic flux to the voice coil 101 and the voice coil 102. A frame 107 holds thereon the suspension 105 and the magnetic circuit 106 to complete a finished speaker unit. A front baffle 108, on which the speaker unit is attached, and a cabinet 109 enclose the rear sound output of the speaker unit.

Figure 2:
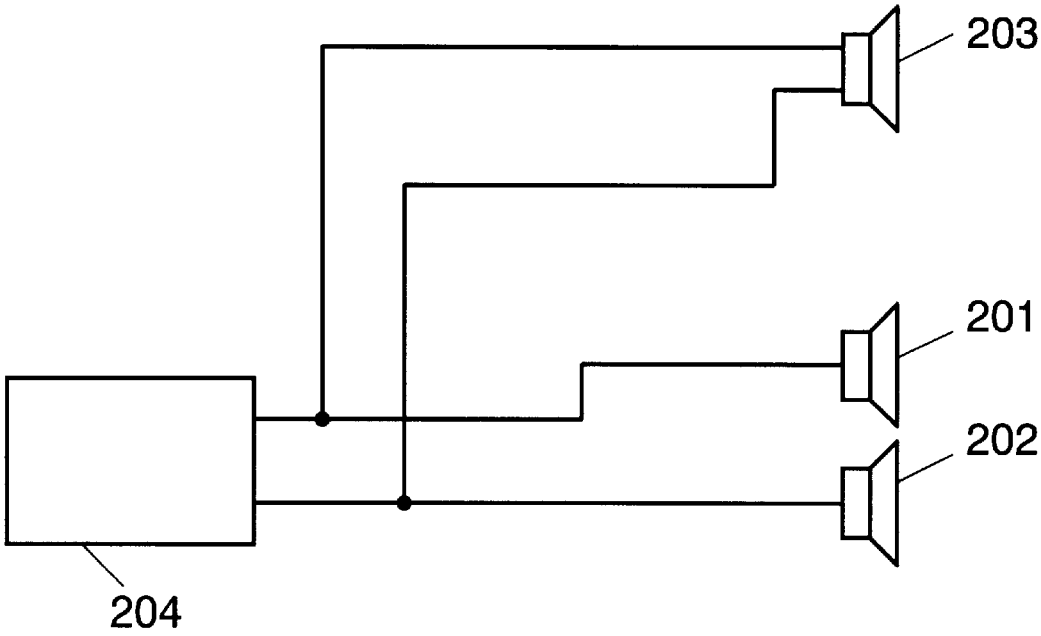
FIG. 2 is a block diagram showing an example where the first sound reproduction apparatus is used as a car-borne apparatus.

FIG. 2 is block diagram showing a case where the first sound reproduction apparatus is used as a car-borne apparatus. In FIG. 2, a left channel speaker apparatus 201 is mounted in a front door at a passenger seat, a right channel speaker apparatus 202 is mounted in a front door at a driver seat, and a center speaker apparatus 203 is disposed at the center, or in the central front space between the left channel speaker apparatus 201 and the right channel speaker apparatus 202 in the room of an automobile body. A sound source 204 comprises a program source, such as a CD player, an FM/AM tuner, and a power amplifier for driving the left channel speaker apparatus 201 and the right channel speaker apparatus 202. A sound input signal for the center speaker apparatus 203 is derived from a branch of each of the sound output signal channels coming from the sound source 204 leading to the left and the right speaker apparatuses. A sound input signal for the center speaker apparatus 203 is not necessarily branched, but may be directly sent from the sound source 204.

Figure 3:
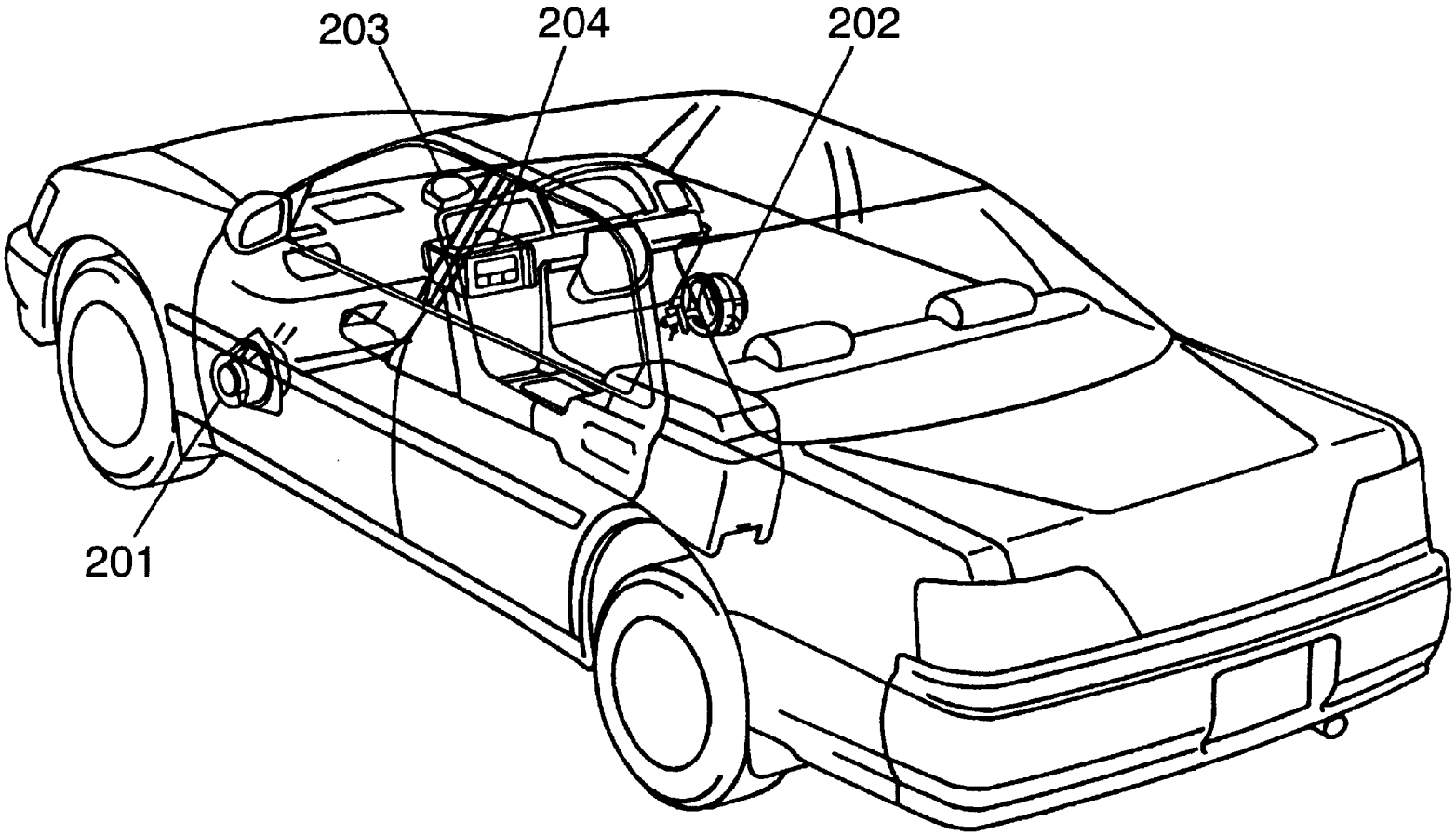
FIG. 3 is a speaker layout of the first sound reproduction apparatus when it is used as a car-borne apparatus.

FIG. 3 illustrates a speaker layout, where the first sound reproduction apparatus is used as a car-borne apparatus. In FIG. 3, the left channel speaker apparatus 201 is mounted in a front door at a passenger seat, while the right channel speaker apparatus 202 is mounted in a front door at a driver seat. The center speaker apparatus 203 is disposed at the center, or in the central front space between the left channel speaker apparatus 201 and the right channel speaker apparatus 202 in the room of an automobile body. The sound source 204 comprises a program source, such as a CD player, an FM/AM tuner, and a power amplifier for driving the left channel speaker apparatus 201 and the right channel speaker apparatus 202.

Figure 4:
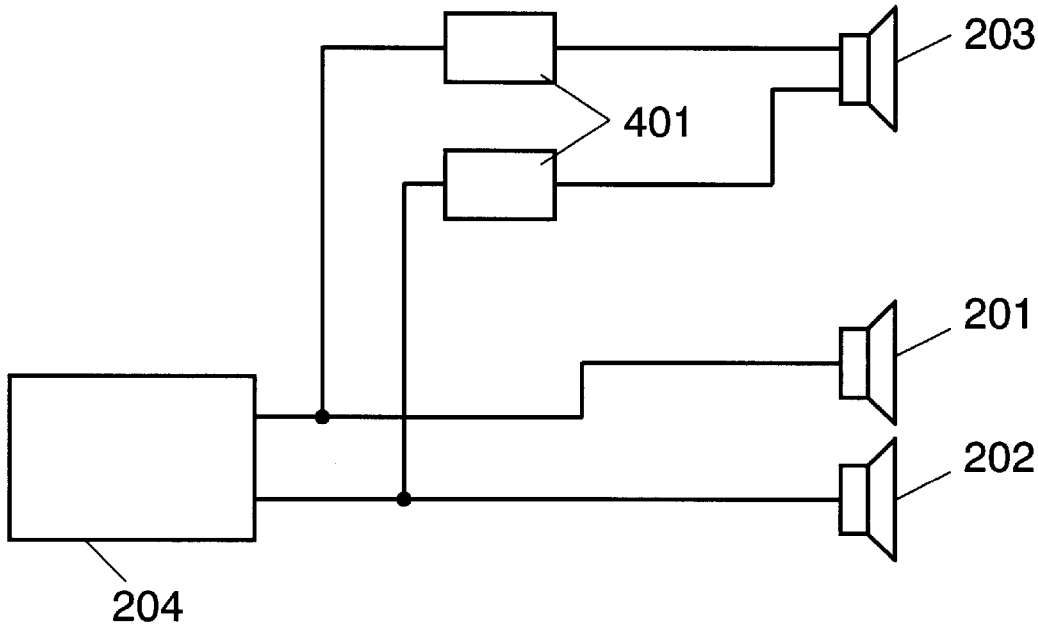
FIG. 4 is a block diagram showing an example where a second sound reproduction apparatus in the present exemplary embodiment is used as a car-borne apparatus.

FIG. 4 is a block diagram which shows a case where a second sound reproduction apparatus is used as a car-borne apparatus. In FIG. 4, a band pass filter 401 is inserted in respective signal channels coming from the sound source 204 leading to the center speaker apparatus 203, at a place between a branching point to the left and the right channel speaker apparatuses and the center speaker apparatus. The band pass filter 401 allows only middle range sound signals including the vocal sound region to go through.

Figure 5:
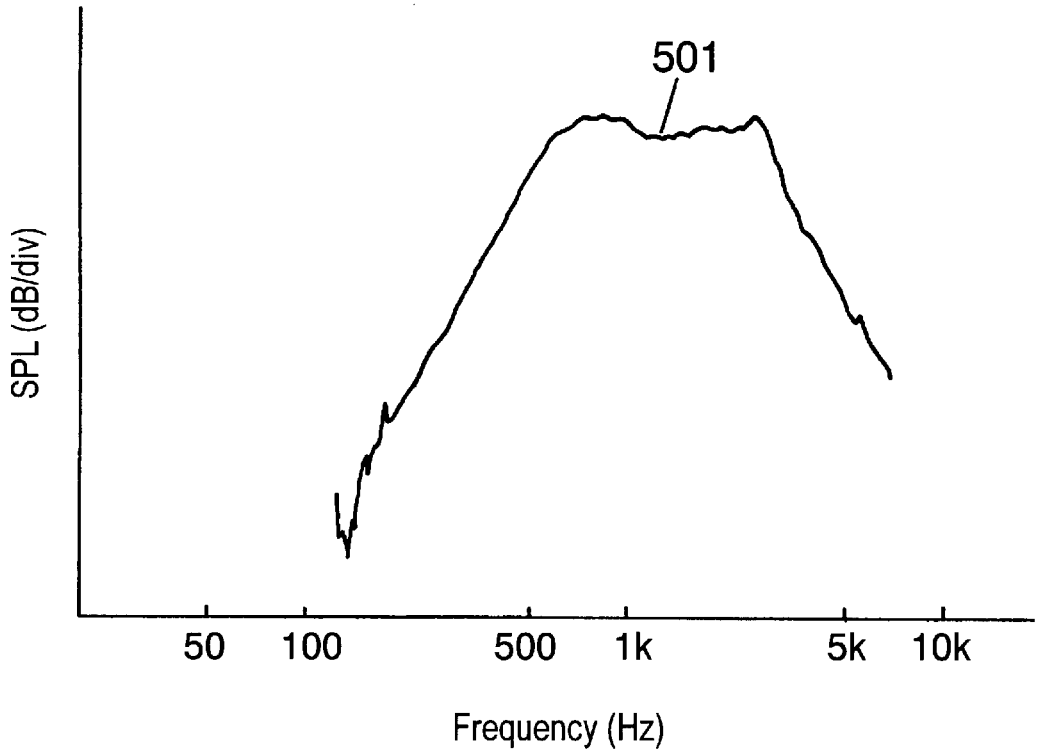
FIG. 5 is a frequency characteristic chart showing output sound pressure of a center speaker apparatus of the second sound reproduction apparatus.

FIG. 5 shows a sound pressure frequency characteristic 501 of the center speaker apparatus 203 in the second sound reproduction apparatus.

Figure 6:
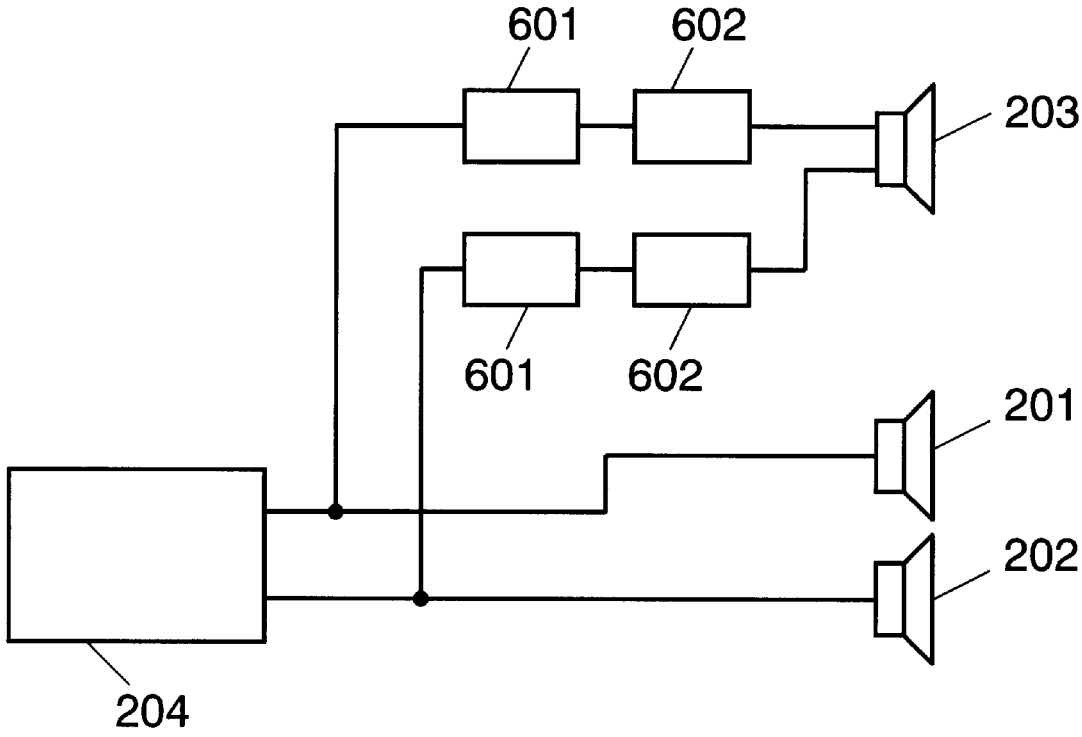
FIG. 6 is a block diagram showing an example where a third sound reproduction apparatus in the present exemplary embodiment is used as a car-borne apparatus.

FIG. 6 is a block diagram which shows a case where a third sound reproduction apparatus is used as a car-borne apparatus. A low pass filter 601 is inserted in respective signal channels coming from the sound source 204 leading to the center speaker apparatus 203, at a place between a branching point to the left and the right channel speaker apparatuses and the center speaker apparatus. A high pass filter 602 is also inserted likewise in respective signal channels leading to the center speaker apparatus 203. A combination of the low pass filter 601 and the high pass filter 602 forms a band pass filter.

Figure 7:
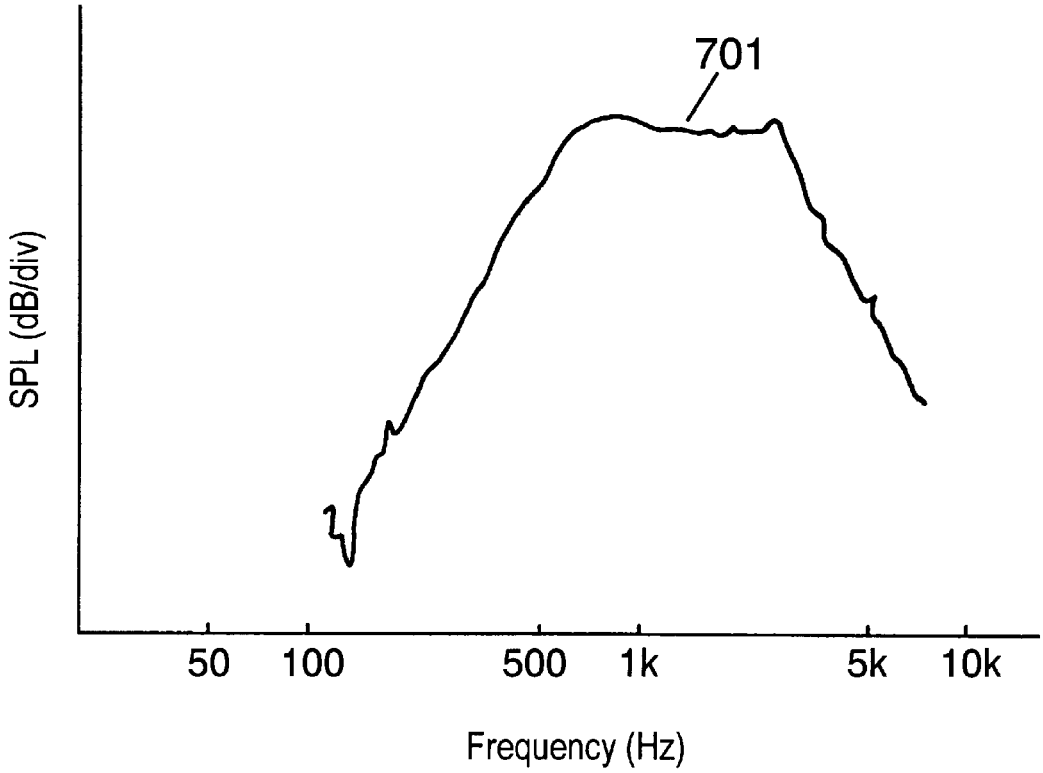
FIG. 7 is a frequency characteristic chart showing output sound pressure of a center speaker apparatus of the third sound reproduction apparatus.

FIG. 7 shows a sound pressure frequency characteristic 701 of the center speaker apparatus 203 in the third sound reproduction apparatus.

Figure 8:
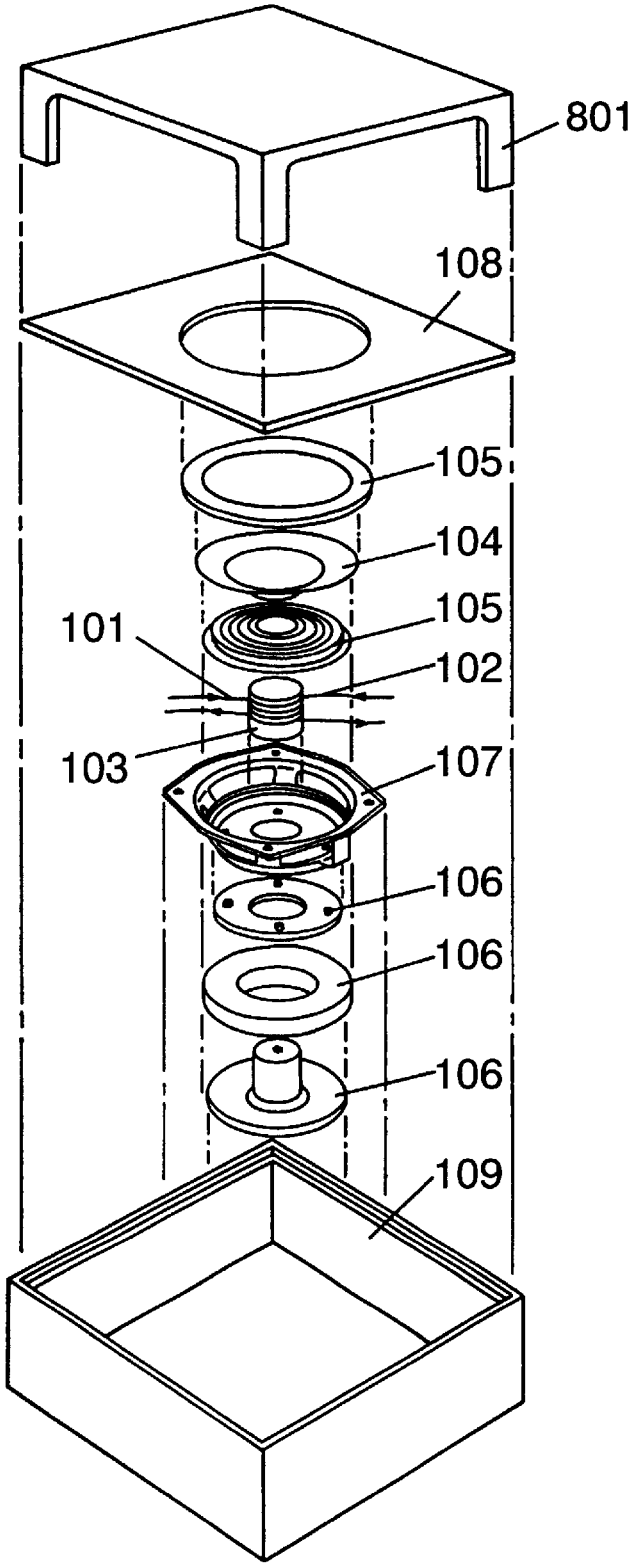
FIG. 8 is an exploded perspective view of a center speaker apparatus of a fourth sound reproduction apparatus in the present exemplary embodiment.

FIG. 8 shows an exploded perspective view of a center speaker apparatus in a fourth sound reproduction apparatus. In FIG. 8, a left-channel voice coil 101 and a right-channel voice coil 102 are provided coaxially on a voice coil bobbin 103. A diaphragm 104 is connected with the voice coil bobbin 103, whose driving force drives the diaphragm to reproduce the sound. The diaphragm 104 and the voice coil bobbin 103 are mechanically supported by a suspension 105. A magnetic circuit 106 provides magnetic flux to the voice coil 101 and the voice coil 102. A frame 107 holds thereon the suspension 105 and the magnetic circuit 106 to complete a finished speaker unit. A front baffle 108, on which the speaker unit is attached, and a cabinet 109 enclose the rear sound output of the speaker unit. A reflector 801 performs a high-cut function of attenuating the high frequency range sounds irradiated from the diaphragm 104.

Figure 9:
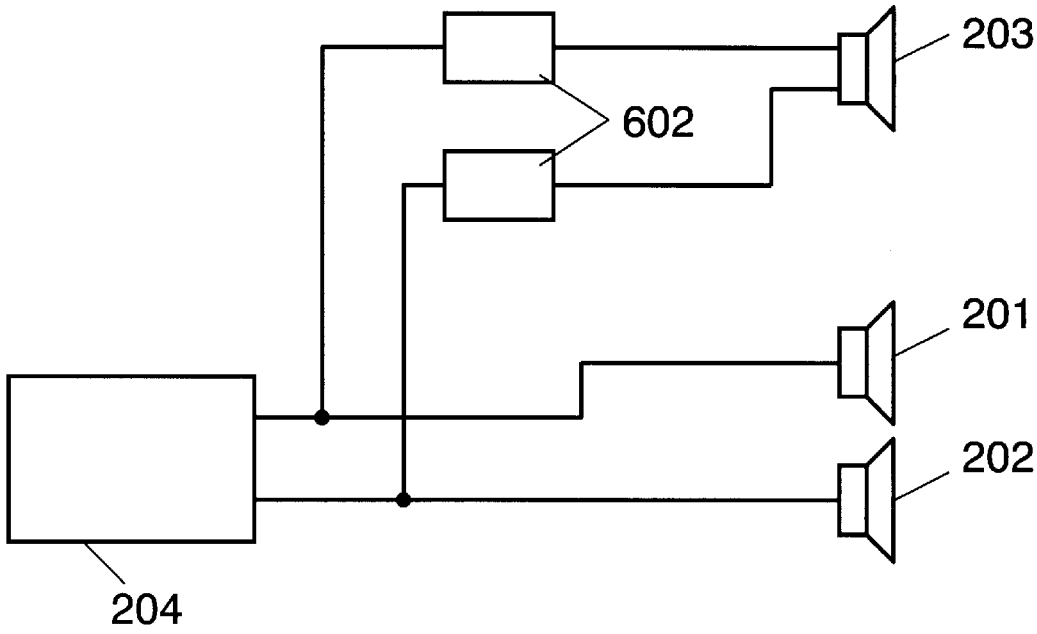
FIG. 9 is a block diagram showing an example where the fourth sound reproduction apparatus is used as a car-borne apparatus.

FIG. 9 is a block diagram which shows a case where the fourth sound reproduction apparatus is used as a car-borne apparatus. A high pass filter 602 is inserted in respective signal channels coming from the sound source 204 leading to the center speaker apparatus 203, at a place between a branching point to the left and the right channel speaker apparatuses 201, 202 and the center speaker apparatus. In the present exemplary embodiment, a combination of the reflector 801 having a high-cut function and the high pass filter 602, both items being attached to the center speaker apparatus, constitutes a band pass filter.

Figure 10:
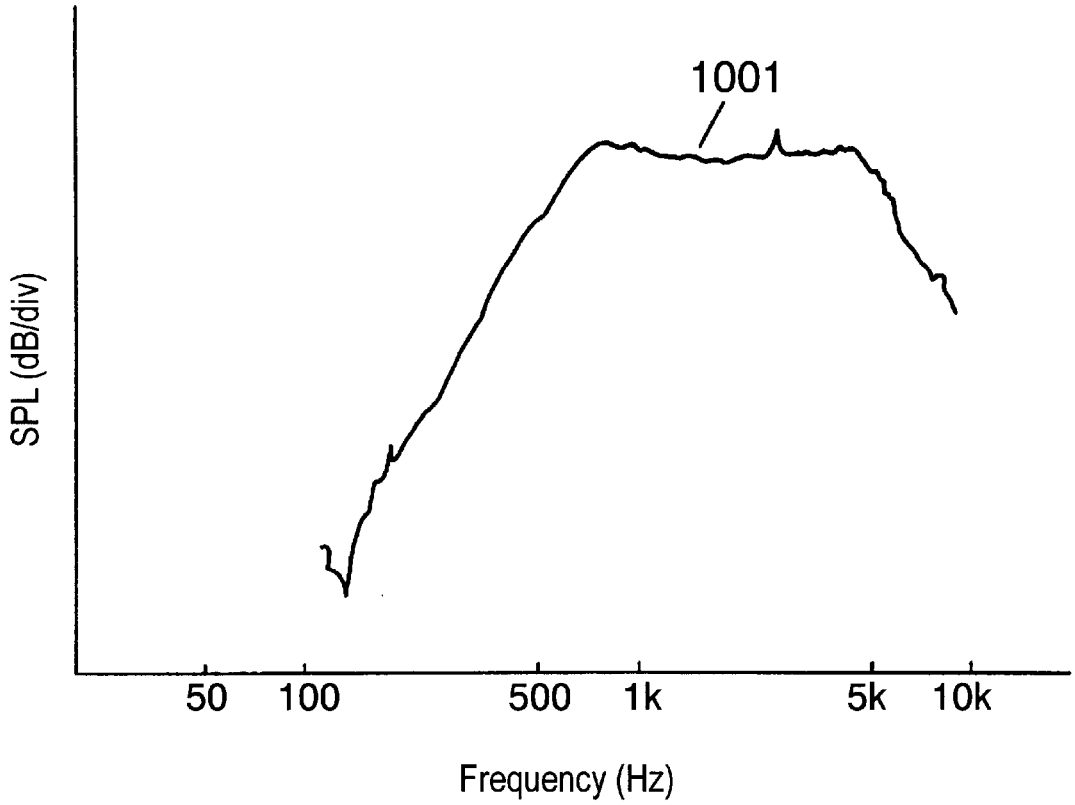
FIG. 10 is a frequency characteristic chart showing output sound pressure of a center speaker apparatus of the fourth sound reproduction apparatus.

FIG. 10 shows a sound pressure frequency characteristic 1001 of the center speaker apparatus 203 in the fourth sound reproduction apparatus.

Figure 11:
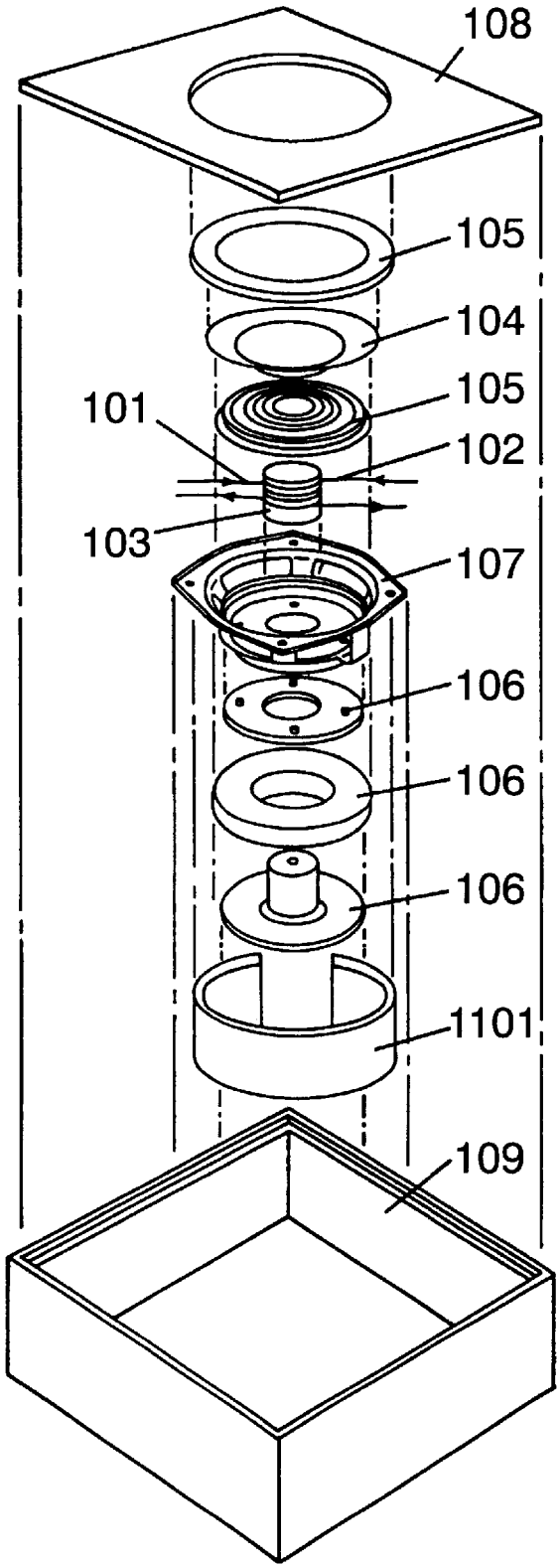
FIG. 11 is an exploded perspective view of a center speaker apparatus of a fifth sound reproduction apparatus in the present exemplary embodiment.

FIG. 11 shows an exploded perspective view of a center speaker apparatus in a fifth sound reproduction apparatus. In FIG. 11, a cabinet 109, which encloses in cooperation with a front baffle 108 the rear sound output of the speaker unit, has been reduced in the inner volume so that it functions as a mechanical low-cut filter by shifting the lowest resonance frequency of center speaker apparatus 203 higher. A sound absorbing material 1101 curtails rise of the quality factor, which emerges when the lowest resonance frequency of center speaker apparatus 203 is shifted higher by a reduced inner volume with the cabinet 109.

Figure 12:
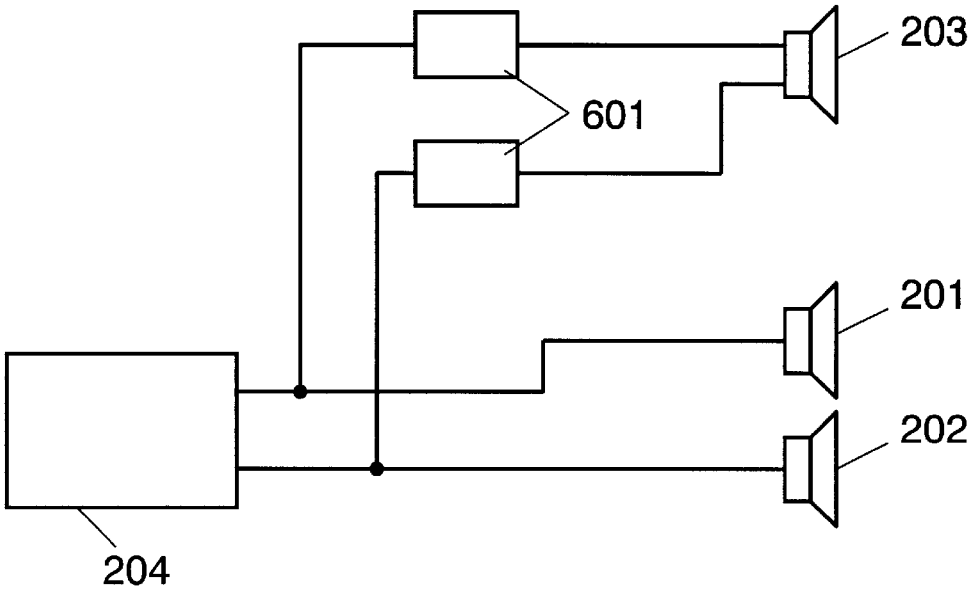
FIG. 12 is a block diagram showing an example where the fifth sound reproduction apparatus is used as a car-borne apparatus.

FIG. 12 is a block diagram showing a case where the fifth sound reproduction apparatus is used as a car-borne apparatus. In FIG. 12, a low pass filter 601 is inserted in respective signal channels coming from the sound source 204 leading to the center speaker apparatus 203, at a place between a branching point to the left and the right channel speaker apparatuses 201, 202 and the center speaker apparatus. In the present exemplary embodiment, a combination of the mechanical low-cut filter function incorporated in the center speaker apparatus 203 and the low pass filter 601 constitutes a band pass filter.

Figure 13:
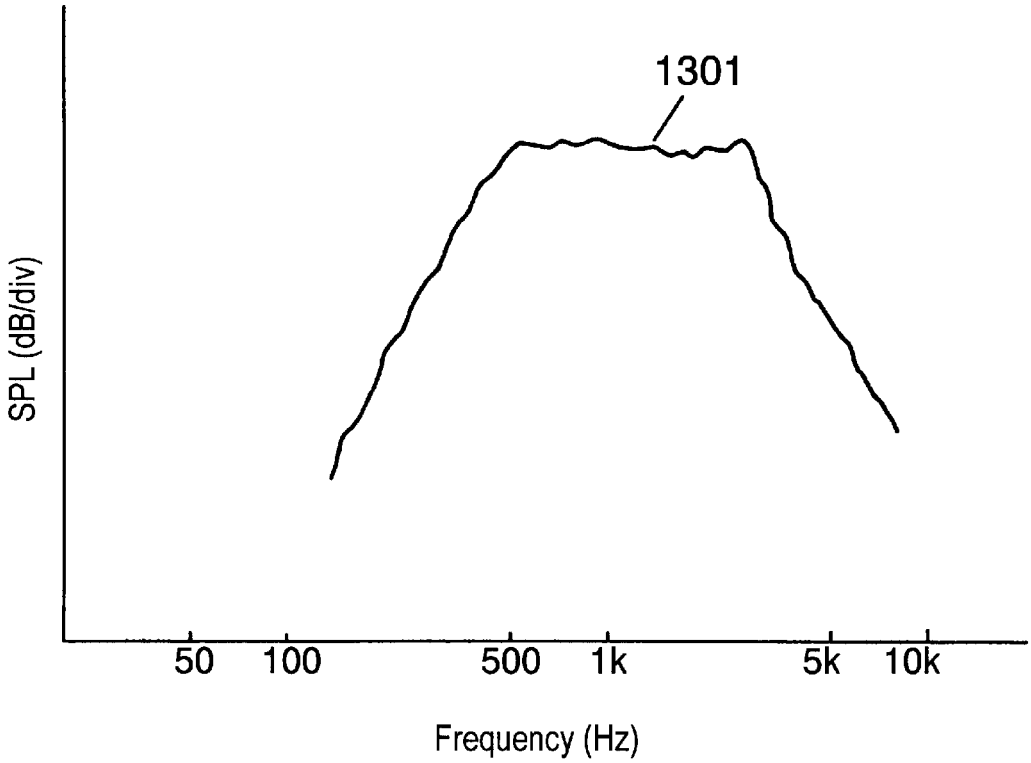
FIG. 13 is a frequency characteristic chart showing output sound pressure from a center speaker apparatus of the fifth sound reproduction apparatus.

FIG. 13 shows a sound pressure frequency characteristic 1301 of the center speaker apparatus 203 in the fifth sound reproduction apparatus.

Figure 14:
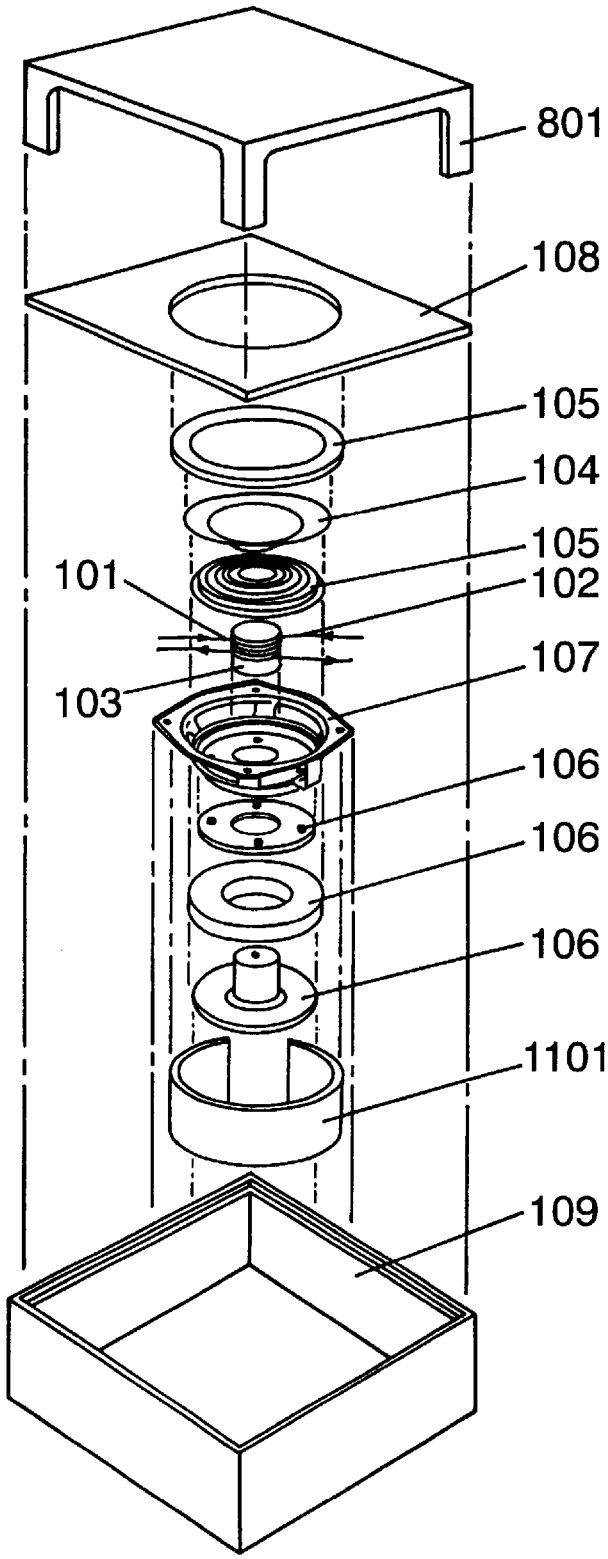
FIG. 14 is an exploded perspective view of a center speaker apparatus of the sixth sound reproduction apparatus in the present exemplary embodiment.

FIG. 14 shows an exploded perspective view of a center speaker apparatus in a sixth sound reproduction apparatus. In FIG. 14, a cabinet 109, which encloses in cooperation with a front baffle 108 the rear sound output of the speaker unit, has been reduced in the inner volume so that it functions as a mechanical low-cut filter by shifting the lowest resonance frequency of center speaker apparatus 203 higher. A reflector 801 performs a high-cut function of attenuating the high frequency range sounds irradiated from the diaphragm 104. A sound absorbing material 1101 curtails rise in the quality factor, which emerges when the lowest resonance frequency of center speaker apparatus 203 is shifted higher by a reduced inner volume with the cabinet 109.

Figure 15:
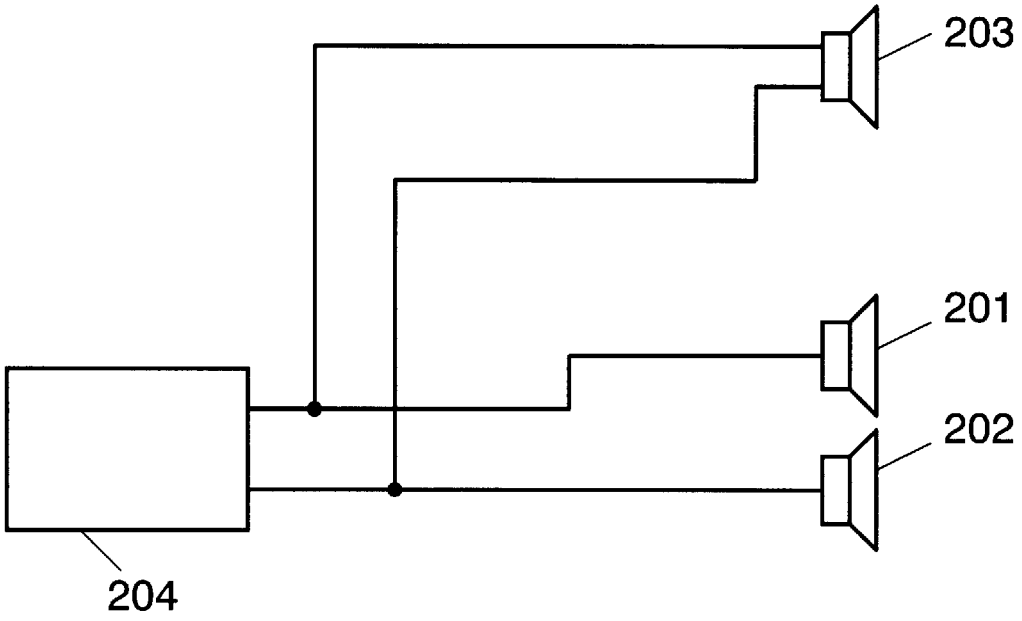
FIG. 15 is a block diagram showing an example where the sixth sound reproduction apparatus is used as a car-borne apparatus.

FIG. 15 is a block diagram showing a case where the sixth sound reproduction apparatus is used as a car-borne apparatus. In FIG. 15, a combination of the reflector 801 having a high-cut function and the mechanical low-cut filter function, both being incorporated in the center speaker apparatus, constitutes a band pass filter. It should be noticed that no filter is required in the sixth sound reproduction apparatus of the present invention.

Figure 16:
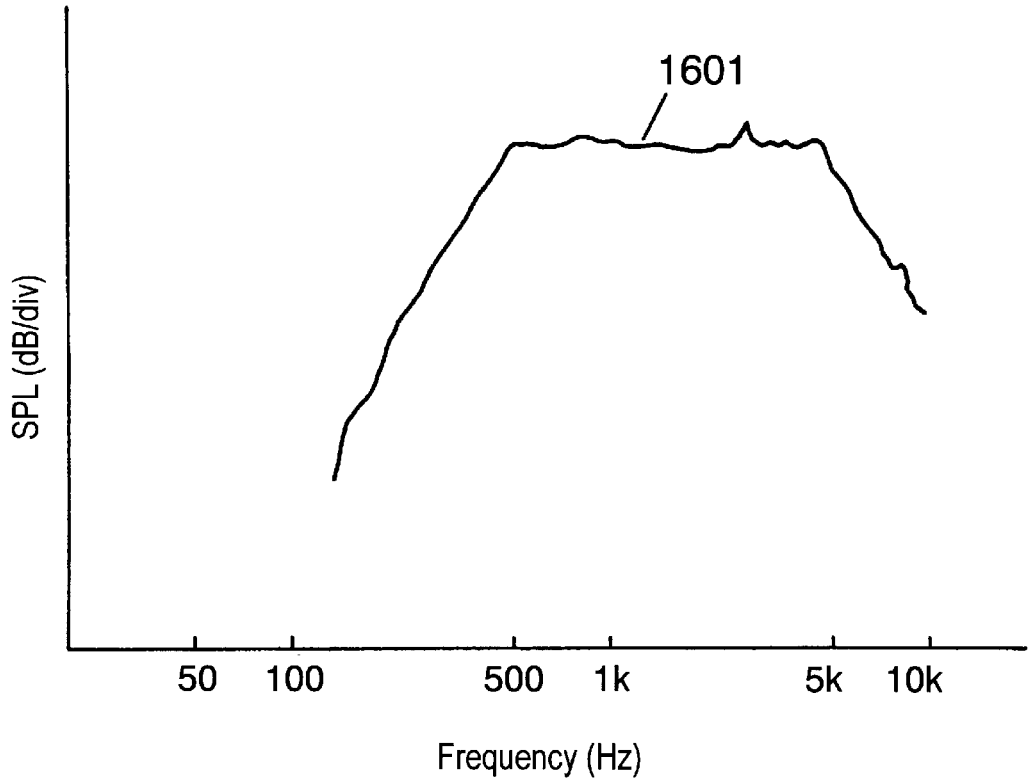
FIG. 16 is a frequency characteristic chart showing output sound pressure from a modified center speaker apparatus of the sixth sound reproduction apparatus.
Figure 17:
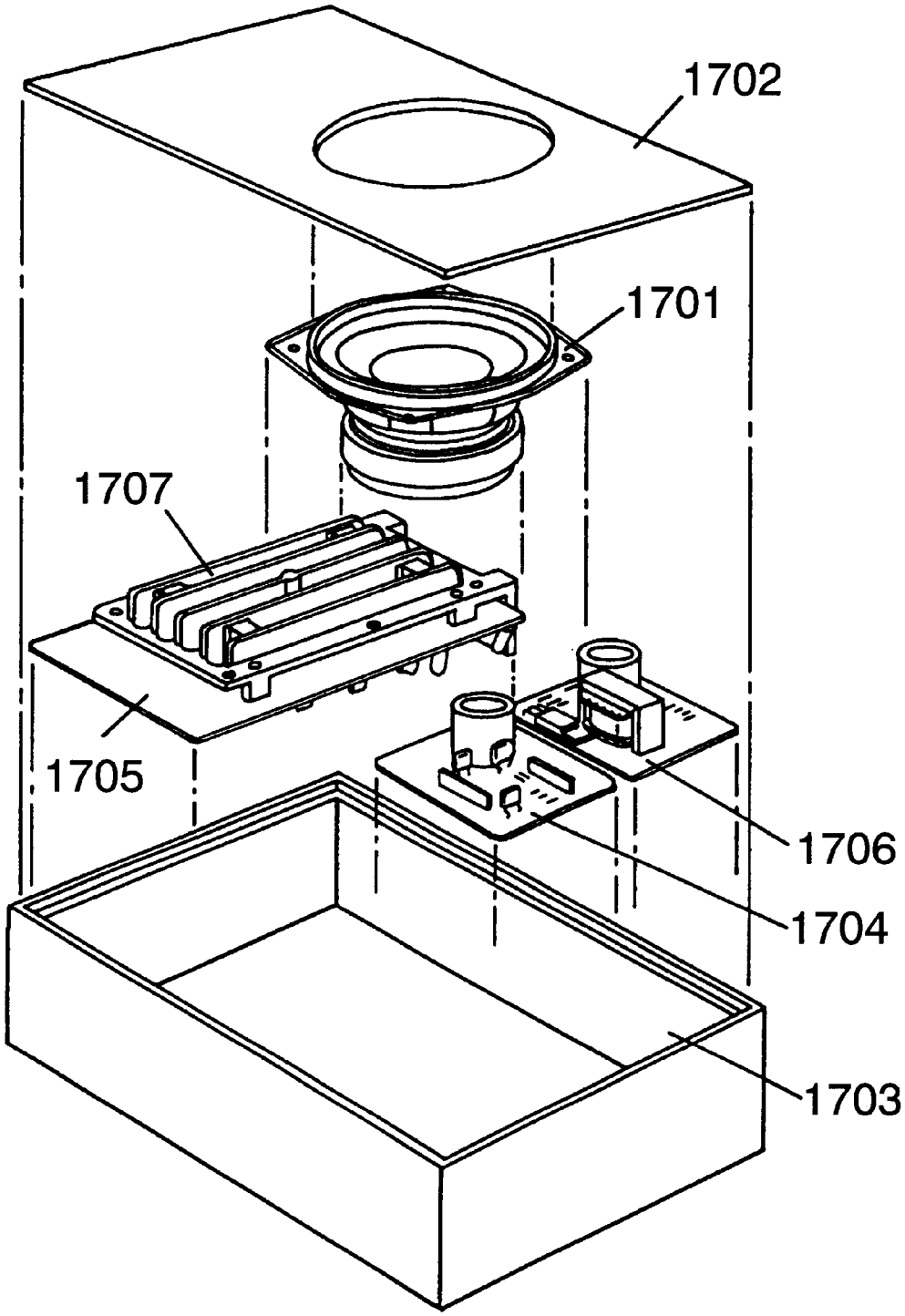
FIG. 17 is a exploded perspective view of a conventional center speaker apparatus.
Figure 18:
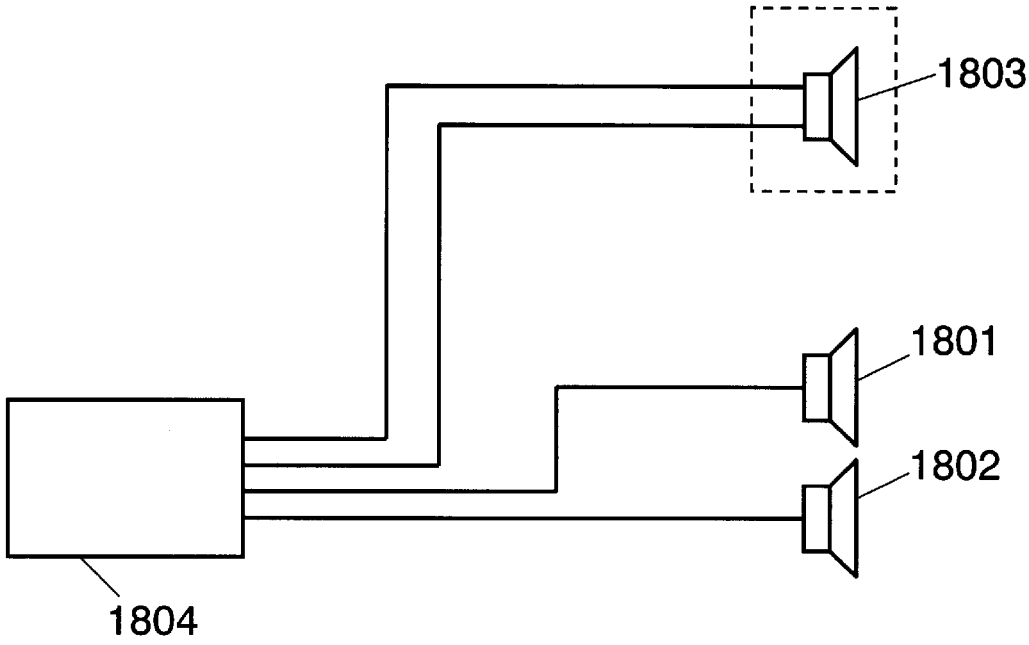
FIG. 18 is a block diagram showing an example where the conventional center speaker apparatus is used as a car-borne apparatus.
Figure 19:
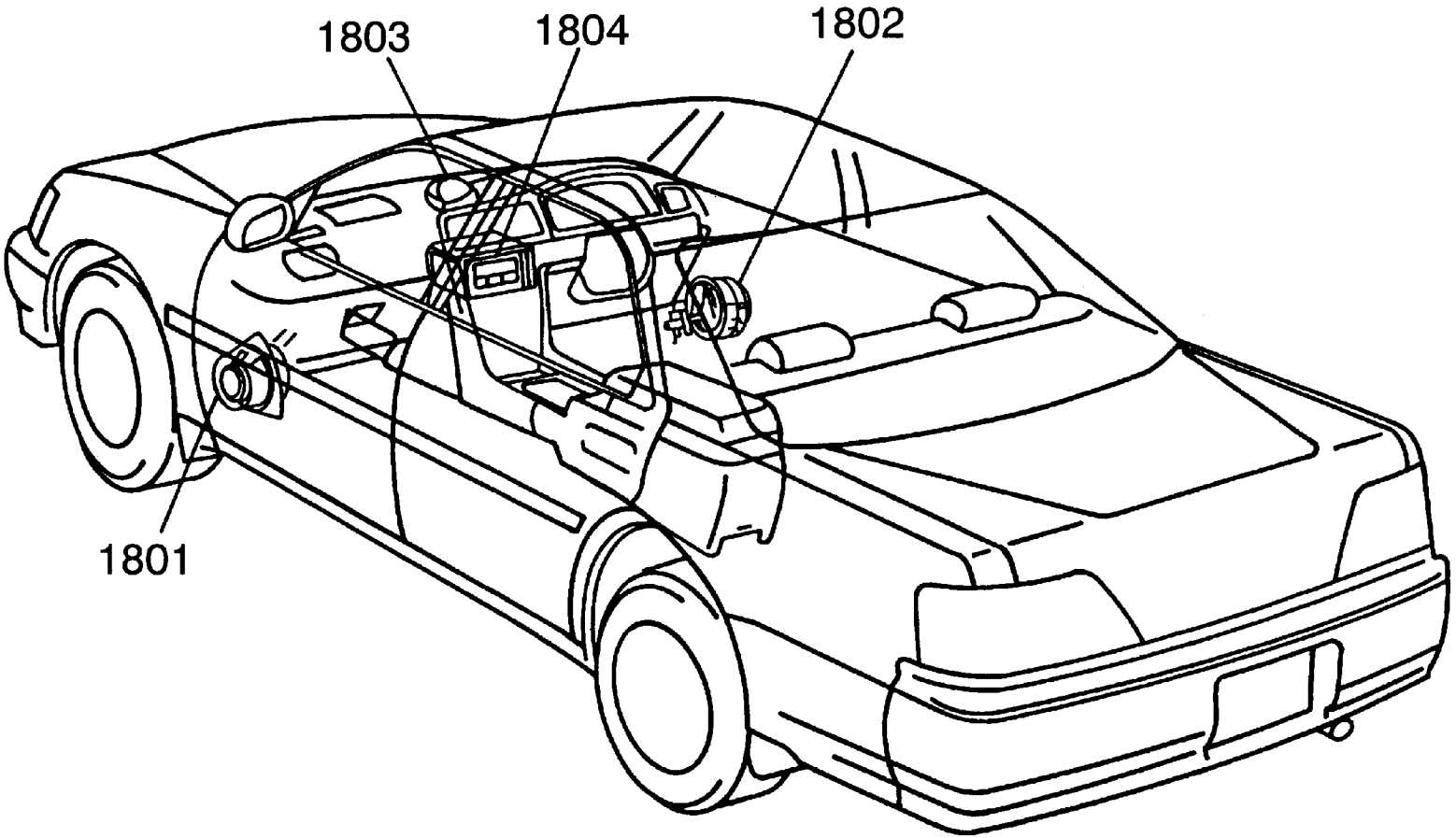
FIG. 19 is a speaker layout showing a case were the conventional center speaker apparatus is used as a car-borne apparatus.

FIG. 16 shows a sound pressure frequency characteristic 1601 of output from the center speaker apparatus 203 in the sixth sound reproduction apparatus.

Now in the following, operation of the above-configured examples, including the modification, of the sound reproduction apparatus is described.

Operation of the first sound reproduction apparatus shown in FIG. 1, FIG. 2 and FIG. 3 is described below.

Sound source 204 of FIG. 2 consists of a program source, such as a CD player, an FM/AM tuner, and a power amplifier for driving the speaker apparatus 201 and the speaker apparatus 202. Sound reproduction is made through these speaker apparatuses 201, 202, which are connected to the sound source 204. A sound input signal to the center speaker apparatus 203 derives from respective sound output channels from the sound source 204 leading the speaker apparatuses 201, 202. Referring to FIG. 1, a sound signal coming from the branching point of the line to the left channel speaker apparatus 201 is led to voice coil 101 , while a sound signal coming from the branching point of the line to the right channel speaker apparatus 202 is led to voice coil 102. The diaphragm 104 is driven via the voice coil bobbin 103 to reproduce sounds. Since the left-channel sound signal and the right-channel sound signal have been arranged so that these signals take a same current direction, the speaker apparatus 203 is driven by a monaural signal equivalent to a mixture of the left channel sound signal and the right channel sound signal.

FIG. 3 illustrates a location of the center speaker apparatus 203 installed in the room of an automobile body. The speaker apparatus 203 is located at the center of dashboard, which place corresponds to the central front space between the speaker apparatus 201 mounted in a front door at a passenger seat and the speaker apparatus 202 mounted in a front door at a driver seat. The monaural signal, being a mixture of the left- and the right-channel signals, reproduced through the speaker apparatus 203, plays a role to position naturally the acoustical image at the central front space.

The second sound reproduction apparatus is described referring to FIG. 4 and FIG. 5. Sound source 204 of FIG. 4 consists of a program source, such as a CD player, an FM/AM tuner, and a power amplifier for driving the speaker apparatus 201 and the speaker apparatus 202. Sound reproduction is made through these speaker apparatuses 201, 202, which are connected to the sound source 204. A band pass filter 401 is inserted in respective signal channels coming from the sound source 204 leading to the center speaker apparatus 203, at a place between a branching point to the left and the right channel speaker apparatuses and the center speaker apparatus. Thus, the center speaker apparatus 203 generates only the middle range sounds including vocal region frequency. In this way, the acoustical image can be positioned naturally at the central front space, without sacrificing the stereophonic sound feeling.

FIG. 5 shows a sound pressure frequency characteristic 501 of the speaker apparatus 203 in the second sound reproduction apparatus. The speaker apparatus 203 reproduces only the middle range sounds including vocal region frequency, the sound range being relevant to positioning, without bringing ill-affect on the stereophonic sound feeling, of the acoustical image.

The third sound reproduction apparatus is described referring to FIG. 6 and FIG. 7. Sound source 204 of FIG. 6 consists of a program source, such as a CD player, an FM/AM tuner, and a power amplifier for driving the left channel speaker apparatus 201 and the right channel speaker apparatus 202. Sound reproduction is made through these speaker apparatuses 201, 202, which are connected to the sound source 204. Both a low pass filter 601 and a high pass filter 602 are inserted in respective paths of a signal coming out of the sound source 204 leading to the center speaker apparatus 203. Thus, the center speaker apparatus 203 generates only the middle range sounds including vocal region frequency. In this way, the acoustical image can be positioned naturally at the central front space, without sacrificing the stereophonic sound feeling.

FIG. 7 shows a sound pressure frequency characteristic 701 of the speaker apparatus 203 in the third sound reproduction apparatus. The speaker apparatus 203 reproduces only the middle range sounds including vocal region frequency, the sound range being relevant to the positioning, without bringing ill-affect on the stereophonic sound feeling, of the acoustical image.

The fourth sound reproduction apparatus is described referring to FIG. 8, FIG. 9 and FIG. 10. Sound source 204 of FIG. 9 consists of a program source, such as a CD player, an FM/AM tuner, and a power amplifier for driving the left channel speaker apparatus 201 and the right channel speaker apparatus 202. Sound reproduction is made through these speaker apparatuses 201, 202, which are connected to the sound source 204. A high pass filter 602 is inserted in respective paths of a signal coming out of the sound source 204 leading to the center speaker apparatus 203. A reflector 801, shown in FIG. 8, having a high-cut function attenuates the high frequency range sound reproduced and irradiated from the diaphragm 104. FIG. 10 shows a sound pressure frequency characteristic 1001 of the speaker apparatus 203 in the fourth sound reproduction apparatus. Thus, the speaker apparatus 203 reproduces only the middle range sounds including vocal region frequency, the sound range being relevant to the positioning, without bringing ill-affect on the stereophonic sound feeling, of the acoustical image.

The fifth sound reproduction apparatus is described referring to FIG. 11, FIG. 12 and FIG. 13. Sound source 204 of FIG. 12 consists of a program source, such as a CD player, an FM/AM tuner, and a power amplifier for driving the left channel speaker apparatus 201 and the right channel speaker apparatus 202. Sound reproduction is made through the left channel speaker apparatus 201 and the right channel speaker apparatus 202, which are connected to the sound source 204. A low pass filter 601 is inserted in respective paths of a signal coming out of the sound source 204 leading to the center speaker apparatus 203. The cabinet 109 shown in FIG. 11 has been reduced in the inner volume so that it provides a mechanical low-cut filter function by shifting the lowest resonance frequency of the speaker apparatus 203 higher. In order to curtail the rise in quality factor of speaker apparatus 203, which is accompanied by the reduced inner volume of the cabinet 109, a sound absorbing material 1101 is provided. FIG. 13 shows a sound pressure frequency characteristic 1201 of the speaker apparatus 203 in the fifth sound reproduction apparatus. The speaker apparatus 203 reproduces only the middle range sounds including vocal region frequency, the sound range being relevant to the positioning, without bringing ill-affect on the stereophonic sound feeling, of the acoustical image.

The sixth sound reproduction apparatus is described referring to FIG. 14, FIG. 15 and FIG. 16. Sound source 204 of FIG. 15 consists of a program source, such as a CD player, an FM/AM tuner, and a power amplifier for driving the left channel speaker apparatus 201 and the right channel speaker apparatus 202. Sound reproduction is made through the left channel speaker apparatus 201 and the right channel speaker apparatus 202, which are connected to the sound source 204. A sound input signal for the center speaker apparatus 203 is delivered from the sound source 204. As shown in FIG. 14, a reflector 801 having a high-cut function attenuates the high frequency region sound of sound output reproduced and irradiated from the diaphragm 104. At the same time, the cabinet 109 has been reduced in the inner volume so that it provides a mechanical low-cut filter function by shifting the lowest resonance frequency of the speaker apparatus 203 higher. In order to curtail the rise in quality factor of speaker apparatus 203, a sound absorbing material 1101 is provided. FIG. 16 shows a sound pressure frequency characteristic 1601 of the speaker apparatus 203 in the sixth sound reproduction apparatus. Thus in the present example, speaker apparatus 203 can reproduce only the middle range sounds including vocal region frequency without making any use of a filter; the sound range being relevant to the positioning, without bringing ill-affect on the stereophonic sound feeling, of the acoustical image.

As described in the foregoing, in a sound reproduction apparatus of the present invention, the two sound output signals from a sound source to be delivered respectively to the left channel speaker apparatus and the right channel speaker apparatus are put into a speaker unit having two voice coils, namely a left-channel voice coil and a right-channel voice coil. As a center speaker apparatus is provided with the speaker unit of the present invention, the voltage amplifier, the power amplifier, the power supply and the heat radiator have been eliminated. Thus, the center speaker apparatus can be made compact and light in weight.

What is claimed is:

1. A sound reproduction apparatus comprising:

a sound source;

a speaker apparatus for a left channel;

a speaker apparatus for a right channel;

a center speaker apparatus disposed at a center, or in a central front space, between said speaker apparatus for the left channel and said speaker apparatus for the right channel, wherein a speaker unit of said center speaker apparatus is provided with a left-channel voice coil for receiving a left channel sound output signal, and a right-channel voice coil for receiving a right channel sound output signal, said left-channel voice coil and said right-channel voice coil being disposed co-axially, wherein said speaker apparatus for the right channel and said speaker apparatus for the left channel are directly connected to said sound source, wherein a first band pass filter is disposed in a signal path leading to said left-channel voice coil, and wherein a second band pass filter is disposed in a signal path leading to said right-channel voice coil.

2. The sound reproduction apparatus of claim 1, wherein said band pass filter is formed of a low pass filter and a high pass filter.

3. The sound reproduction apparatus of claim 1, wherein a high pass filter is inserted in the signal path leading to said left-channel voice coil and the signal path leading to said right-channel voice coil, and wherein the center speaker apparatus is provided with a reflector disposed in front of a diaphragm, said reflector functioning as a high-cut filter.

4. The sound reproduction apparatus of claim 1, wherein a low pass filter is inserted in the signal path leading to said left-channel voice coil and the signal path leading to said right-channel voice coil, and wherein a speaker box of said center speaker apparatus is provided with a low-cut filter function by shifting a lowest resonance frequency higher.

5. The sound reproduction apparatus of claim 1, wherein said center speaker apparatus is provided with a reflector disposed in front of a diaphragm, said reflector functioning as a high-cut filter, and wherein a speaker box of said center-speaker apparatus is provided with a low-cut filter function by shifting a lowest resonance frequency higher.

6. A sound reproduction apparatus comprising:

a speaker apparatus for a left channel;

a speaker apparatus for a right channel;

a center speaker apparatus disposed at a center, or in a central front space, between said speaker apparatus for the left channel and said speaker apparatus for said right channel, wherein a speaker unit of said center speaker apparatus is provided with a left-channel voice coil for receiving a left channel sound output signal, and a right-channel voice coil for receiving a right channel sound output signal, said left-channel voice coil and said right-channel voice coil being disposed co-axially, wherein a high pass filter is inserted in the signal path leading to said left-channel voice coil and the signal path leading to said right-channel voice coil, and wherein said center speaker apparatus is provided with a reflector disposed in front of a diaphragm, said reflector functioning as a high-cut filter.

* * * * *